United States Patent [19]

Mikiya et al.

[11] Patent Number: 4,982,461

[45] Date of Patent: Jan. 8, 1991

[54] BATHTUB HAVING A PUMP, AND BATH SYSTEM HAVING A PUMP

[75] Inventors: Toshio Mikiya; Haruki Nakao, both of Tokyo, Japan

[73] Assignee: Nikko Co., Ltd., Tokyo, Japan

[21] Appl. No.: 526,528

[22] Filed: May 21, 1990

Related U.S. Application Data

[63] Continuation of Ser. No. 304,591, Feb. 1, 1989, abandoned.

[30] Foreign Application Priority Data

Feb. 8, 1988 [JP] Japan ..... 63-15508
Feb. 8, 1988 [JP] Japan ..... 63-15509

[51] Int. Cl.[5] ..... A61H 33/02
[52] U.S. Cl. ..... 4/544
[58] Field of Search ..... 4/538, 541–544, 4/417–420

[56] References Cited

U.S. PATENT DOCUMENTS

| | | | |
|---|---|---|---|
| 2,506,886 | 5/1950 | Okulitch | 417/420 X |
| 3,321,081 | 5/1967 | Willinger | 417/420 X |
| 3,647,314 | 3/1972 | Laessig | 417/420 X |
| 3,767,330 | 10/1973 | Signorile | 417/420 |
| 3,802,804 | 4/1974 | Zimmerman | 417/420 X |
| 3,865,729 | 2/1975 | Baensch | 417/410 X |
| 4,184,090 | 1/1980 | Taiani et al. | 417/420 X |

*Primary Examiner*—Charles E. Phillips

[57] ABSTRACT

A bathtub having a pump, comprising a tub having side walls one of which has an inner surface, an outer surface, and a thin portion made of magnetically permeable material, pump means secured to the inner surface of the thin portion, for taking in hot water from said tub and pressurizing the hot water, motor means secured to the outer surface of the thin portion and opposing said pump means, and a magnetic coupling means for mangetically connecting said pump means and said motor means.

5 Claims, 9 Drawing Sheets

BATHTUB HAVING A PUMP, AND BATH SYSTEM HAVING A PUMP

This is a continuation of application Ser. No. 07/304,591, filed Feb. 1, 1989, now abandoned.

BACKGROUND OF THE INVENTION

1. Field of the Invention

The present invention relates to a bathtub and a bath system, either having a pump, which comprise a pump unit and a motor unit separated from the pump unit.

2. Description of the Related Art

A pump unit is known which is designed for use in combination with a bathtub, for pumping hot water from the bathtub and jetting the hot water into the bath through a nozzle. The pump unit comprises a pump and a motor which are coupled to each other, and located within the bathtub. The shaft of the pump is mechanically connected to the shaft of the motor by means of a coupling. There remains the risk that hot water leaks from the chamber of the pump into the motor along the shafts of the pump and motor.

Of course, a watertight sealing member, such as an O-ring, is interposed between the motor shaft and housing of the motor, thereby to prevent the hot water from leaking out of the pump chamber. Despite this, the sealing member can not achieve sufficient sealing since it is in sliding contact with the shaft of the pump. In fact, it cannot prevent the hot water, which wets the shaft of the pump, from leaking from the pump housing into the motor through the gap between the motor shaft and the sealing member. The not water flowing into the motor reduces the operating efficiency of the motor, however small the amount of the hot water. Inevitably, the reliability of the pump unit is not sufficiently high.

SUMMARY OF THE INVENTION

Accordingly it is the object of the present invention to provide a bathtub and a bath system, either having a pump, which comprises a pump unit including the pump, and a motor unit separated from the pump and magnetically coupled with the pump so that no water leaks from the bathtub into the motor along the shaft of the pump.

According to an aspect of the invention, there is provided a bathtub having a pump, comprising a tub having side walls one of which has an inner surface, an outer surface, and a thin portion made of magnetically permeable material, pump means secured to the inner surface of the thin portion, for taking in hot water from said tub and pressurizing the hot water, motor means secured to the outer surface of the thin portion and opposing said pump means, and a magnetic coupling means for magnetically connecting said pump means and said motor means.

The motor means and the pump means are separated from each other, with the wall interposed between them. The motor means and the pump means have a rotary section each. The rotary sections are located near, and oppose each other. They constitute a magnetic coupling. More precisely, they contains at least one magnet each. When the motor means, which is located outside the wall, is driven, the pump means is driven since it is coupled with the motor means by the magnetic coupling. As a result, the pump means takes in the hot water from the tub and ejects a jet stream cf the hot water back into the tub.

Therefore, there is no possibility that the hot water leaks from the tub into the motor means through the rotary section of the pump means. In addition, the motor means is electrically insulated from the bathroom in which the humidity is high. Hence, there is no risk that the occupant of the tub suffers from an electric shock. Thus, the motor means can be driven by the commercially available voltage; the voltage need not be reduced to a low one, such as 12 V. The bathtub is safe, although the motor means is drive with a high voltage. Further, since no openings are made in the wall, through which to couple the pump means (located inside the wall) to the motor means (located outside the wall), the noise made by the motor means does not come into the bathroom within the wall.

Moreover, since the motor means is arranged outside the wall surrounding the tub, the tub is more spacious than in the case where the motor means is located within the tub. This not only assure users comfortable bathing, but also allow them to enjoy water-jet massage in the tub. In addition, the pump means can be removed from the tub, in which case the tub will be even more spacious and will be used an ordinary tub.

According to another aspect of the present invention, there is provided a bath system having a pump, comprising a tub, a wall surrounding the tub and having a thin portion made of magnetically permeable material and having an inner surface and an outer surface, pump means secured to the inner surface of the thin portion, for taking in hot water from said tub and pressurizing the hot water, motor means secured to the outer surface of the thin portion and opposing said pump means, and a magnetic coupling means for magnetically connecting said pump means and said motor means.

The motor means and the pump means are separated from each other, with the wall interposed between them. The motor means and the pump means have a rotary section each. The rotary sections are located near, and oppose each other. They constitute a magnetic coupling. More precisely, they contains at least one magnet each. When the motor means, which is located outside the wall, is driven, the pump means is driven since it is coupled with the motor means by the magnetic coupling. As a result, the pump means takes in the hot water from the tub and ejects a jet stream of the hot water back into the tub. The pump means not only can accomplish waterjet massage or bubble massage in the tub. But also can it supply hot water from the bathtub to the tub of, for example, a washing machine.

Hence, the bath system according to the invention has no possibility that the tot water leaks from the tub into the motor means through the rotary section of the pump means. In addition, the motor means is electrically insulated from the bathroom in which the humidity is high. Thus there is no risk that the occupant of the tub suffers from an electric shock. Thus, the motor means can be driven by the commercially available voltage; the voltage need not be reduced to a low one, such as 12 V. The bath system is safe, although the motor means is driven with a high voltage. Furthermore, since no openings are made in the wall, through which to couple the pump means (located inside the wall) to the motor means (located outside the wall), the noise made by the motor means does not come into the bathroom within the wall. It can therefore be maintained quiet in the bathroom.

DETAILED DESCRIPTION OF THE PREFERRED EMBODIMENTS

Preferred embodiments of the present invention will now be described with reference to the accompanying drawings.

Figure 1:
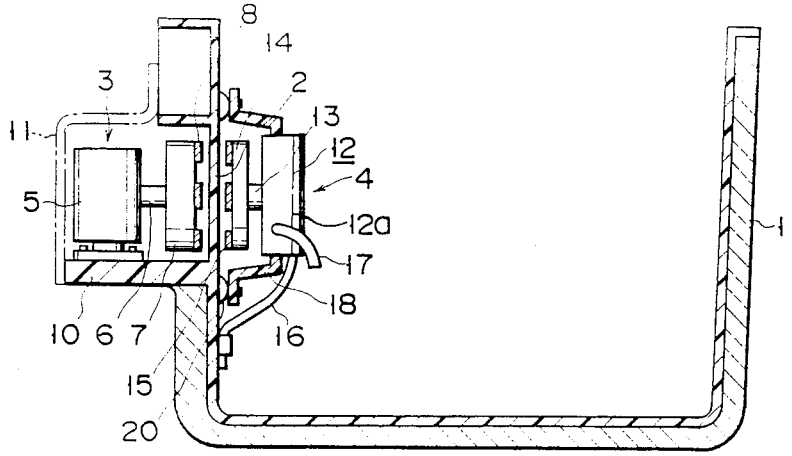
FIG. 1 is a cross-sectional view showing a bathtub according to a first embodiment of the invention.

FIG. 1 shows the bathtub according to a first embodiment of the invention. The bathtub 1 is made of non-magnetic material, or more precisely hard plastics not permeating magnetism. One of the side walls defining the bathtub 1 has a thin portion 2. A motor unit 3 is attached to the outer surface of the thin portion 2. A pump unit 4 is secured to the inner surface of the thin portion 2 and axially aligned with the pump unit 3.

Figure 2:
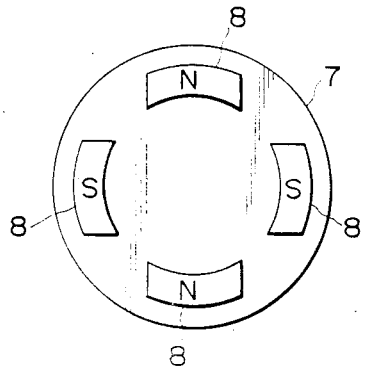
FIG. 2 is a diagram showing the positions of the permanent magnets incorporated in the first embodiment.

The motor unit 3 comprises an electric motor 5, a drive drum 7 fastened to the shaft 6 of the motor 5, and a plurality of permanent magnets 8 attached, by means of adhesive or the like, to that surface of the drive drum 7 which faces the outer surface of the thin portion 2. As is shown in FIG. 2, the magnets 8 of N pole and the magnets of S pole are alternately arranged in a circle, set apart from one another at regular intervals. The magnets 8 are spaced a little from the inner surface of the thin portion 2. According to the invention, all magnets 8 can be of either the N pole or the S pole. The motor 5 is secured, by means of fastening means such as bolts, to a support 10 formed integral with the side wall of bathtub 1. The motor unit 3 is protected by a cover 11. The cover 11 can be dispensed with.

The pump unit 4, which is located inside the walls of bathtub 1, comprises a pump 12. The pump 12 has a casing 12*a* (i.e., the chamber of the pump). The casing 12*a* contains an impeller (not shown). The shaft 13 of the impeller protrudes from casing 12*a*. A driven drum 14 is attached to the end of this shaft 13, and oppose the inner surface of thin portion 2. A plurality of permanent magnets 15 is attached to that surface of driven drum 14 which faces inner surface of the thin portion 2. The magnets 15 of N pole and the magnets of S pole are alternately arranged in a circle, set apart from one another at regular intervals, as is shown in FIG. 2. These magnets 15 and the magnets 8 attached to drive drum 7 constitute a coupling for magnetically connecting the shaft 13 of the pump 12 to the shaft 6 of motor 5. Thus, when the shaft 6 of the motor 5 rotates, the shaft 13 of the pump 12 is rotated. As a result, the impeller, which is coupled to the shaft 13 and contained in casing 12*a*, is driven, thus pumping the hot water from bathtub 1 into the casing 12*a* through intake hose 16. As the impeller keeps on rotating, the pressure of the water in the casing 12*a* increases. The pressurized water flows from the outlet port of the pump 12 to the nozzle of a massage device (not shown) through discharge hose 17. The hot water jets out of the nozzle into the hot water in the bathtub 1, thus applying successful water-jet massage to the occupant of the bathtub.

The pump unit 4 has legs 18. These legs 18 are connected to suction cups 20 attached to the inner surface the thin portion 2, as is shown in FIG. 1. The pump unit 4 is thereby secured to the bathtub 1. Instead, the pump unit 4 can be fastened to the bathtub 1 by means of bolts and nuts.

As has been described, the motor unit 3 and the pump unit 4 are located in face-to-face relation, with the thin portion 2 interposed between them, and the motor unit 3 is positioned outside the bathtub 1. Therefore, no water can leak from the bathtub 1 into the motor unit 3 along the shaft 13 of the impeller incorporated in the pump unit 4. Hence, no troubles are likely to occur in the motor unit 3. In addition, since the motor unit 3 is arranged outside the bathtub 1, the bathtub is advantageous in two respects. First, bathtub 1 is more spacious than in the case where the motor unit 3 is arranged within tub 1. Secondly, when that wall of tub 1 which has the thin portion 2 is used as a partition for the bathroom, the occupant of the bathtub 1 will not be disturbed by the noise the motor unit 3 makes.

Figure 3:
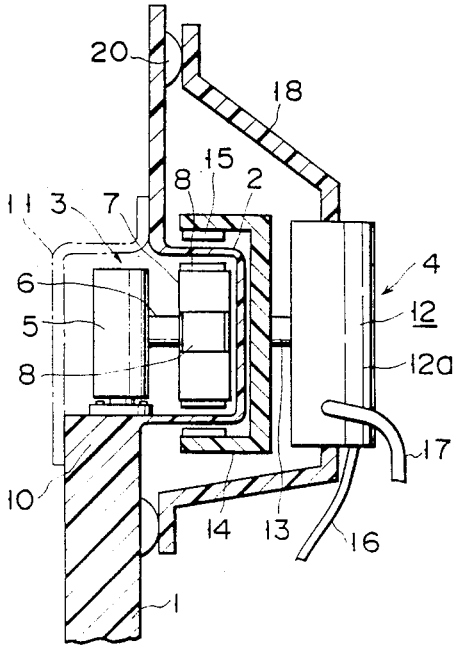
FIG. 3 is a sectional view illustrating the major components of a bathtub according to a second embodiment of this invention.

FIG. 3 shows the bathtub according to a second embodiment of the invention. In FIG. 3, the same numerals are used to designate the same components as those shown in FIG. 1. One of its side walls has a thin portion 2 bulging into bathtub 1 and having a cross section like that of a channel bar. A motor unit 3 is provided within the bathtub 1, and a pump unit 4 is located outside the bathtub 1. These units 3 and 4 are arranged, opposite to each other, with the thin portion 2 interposed between them. The motor unit 3 and the pump unit 4 are magnetically coupled, as will be detailed below.

Figure 4:
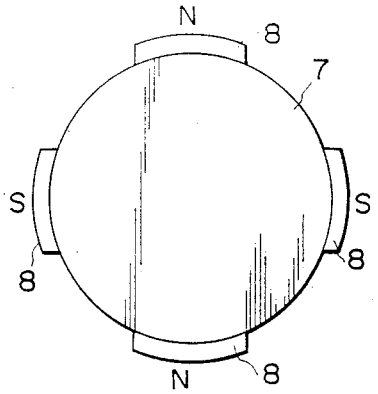
FIG. 4 is a diagram showing the positions of the permanent magnets used in the second embodiment.

As is illustrated in FIG. 3, the motor unit 3 comprises an electric motor 5, a drive drum 7 fastened to the shaft 6 of the motor 5, and a plurality of permanent magnets 8 attached to the circumferential surface of the drive drum 7. As is shown in FIG. 4, the magnets 8 of N pole and the magnets of S pole are alternately arranged on the circumferential surface of the drum 7, set apart from one another at regular intervals. The pump unit 4 comprises a pump 12. The pump 12 has a casing 12*a* (i.e., the chamber of the pump). The casing 12*a* contains an impeller (not shown). The shaft 13 of the impeller protrudes from casing 12*a*. A hollow cylindrical, driven drum 14 is attached to the end of this shaft 13, is positioned coaxial with the drive drum 7, and surrounds the circumferential surface of the drum 7. A plurality of permanent magnets 15 is attached to the inner circumferential surface of driven drum 14. The magnets 15 of N pole and the magnets of S pole are arranged in the same way as the magnets 8 are on the circumferential surface of the drive drum 7. As in the first embodiment, the magnets 8 and the magnets 15 constitute a coupling for magnetically connecting the shaft 13 of the pump 12 to the shaft 6 of motor 5. Thus, when the shaft 6 of the motor 5 rotates, the shaft 13 of the pump 12 is rotated.

The second embodiment shown FIG. 3 is identical with the first embodiment (FIG. 1), in all other structural aspects. It achieves the same advantages as the first embodiment (FIG. 1).

Figure 5:
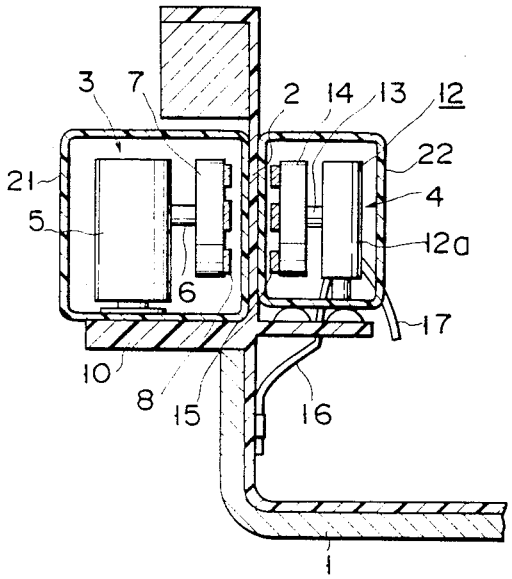
FIG. 5 is a sectional view illustrating the main components of a bathtub according to a third embodiment of the present invention.

FIG. 5 illustrates the bathtub according to a third embodiment of the invention. In this figure, the same numerals are used to denote the same components as those shown in FIG. 1. One of its side walls has a thin portion 2. A motor unit 3 is provided within the bathtub 1, and a pump unit 4 is located outside the bathtub 1. The units 3 and 4 are arranged, opposite to each other, with the thin portion 2 interposed between them. The units 3 and 4 are magnetically coupled, as will be detailed in the following paragraph.

As is illustrated in FIG. 5, the motor unit 3 comprises an electric motor 5, a drive drum 7 fastened to the shaft 6 of the motor 5, and a plurality of permanent magnets 8. The magnets 8 are attached to the drive drum 7 and arranged exactly in the same manner as in the first embodiment, as is shown in FIG. 2. The pump unit 4 comprises a pump 12. The pump 12 has a casing 12*a* (i.e., the chamber of the pump). The casing 12*a* contains an impeller (not shown). The shaft 13 of the impeller protrudes from casing 12*a*. A driven drum 14 is attached to the end of this shaft 13 and positioned coaxial with the drive drum 7. A plurality of permanent magnets 15 is attached to the that face of the drum 14 which faces the inner surface of the thin portion 2. This magnets 15 are arranged in the same way as the magnets 8. As in the first embodiment, the magnets 8 and the magnets 15 constitute a coupling for magnetically connecting the shaft 13 of the pump 12 to the shaft 6 of motor 5. Thus, when the shaft 6 of the motor 5 rotates, the shaft 13 of the pump 12 is rotated.

The third embodiment is different from the first embodiment in that two envelopes 21 and 22, either made of a synthetic resin, cover the motor unit 3 and the pump unit 4, respectively. These envelopes 21 and 22 prevent water from leaking into the units 3 and 4. In any other structural aspect, the third embodiment shown FIG. 5 is identical with the first embodiment (FIG. 1). Also, it accomplishes the same advantages as the first embodiment (FIG. 1).

Figure 6:
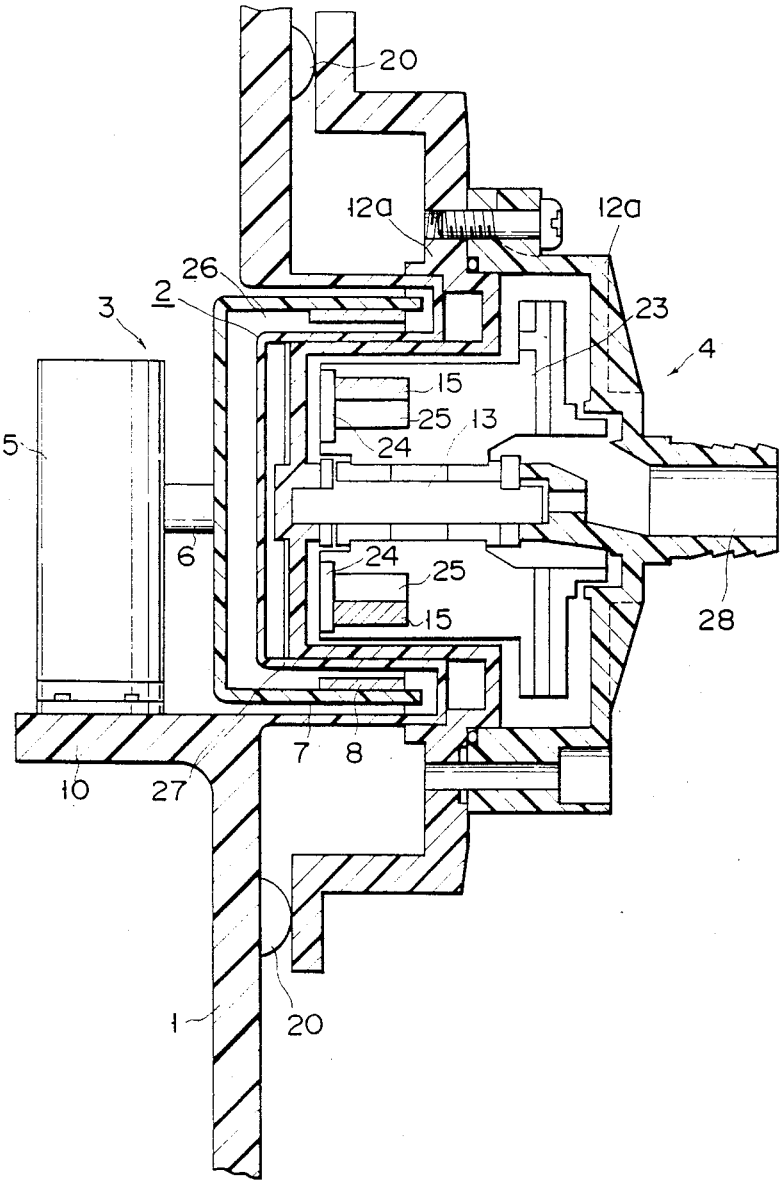
FIG. 6 is a sectional view illustrating the major components of a bathtub according to a fourth embodiment of the present invention.

FIG. 6 shows the bathtub according to a fourth embodiment of these invention. This embodiment is a modification of the second embodiment shown in FIG. 4. In FIG. 6, the same numerals are used to designate the same components as those shown in FIG. 4. The fourth embodiment differs in two respects. First, the drive drum 7 is a hollow cylinder, and the permanent magnets 8 are attached to the inner circumferential surface of the drum 7. Secondly, the permanent magnets 15 are attached to the vanes 23 of the impeller contained in the casing 12*a*. More specifically, support plates 24 are fixed to the tips of the vanes 23, yokes 25 are secured, at one end, to the support plates 24 and extend parallel to permanent magnets 8, and the permanent magnets 15 are fastened to the outer peripheries of these yokes 25.

The fourth embodiment also differs in that the thin portion 2 is bent in the form of a hat, such that an annular space 26 and a bottomed hollow cylinder 27 are formed. The drive drum 7, which is a hollow cylinder, is loosely inserted in this space 26. The casing 12*a*, which is a bottomed cylinder, is mounted on the hollow cylinder 27. As has been described, the permanent magnets 8 are fastened to the inner circumferential surface of the drum 7, and the permanent magnets 15 are attached to the vanes 23 of the impeller. Hence, the shaft 6 of the motor 5 is magnetically coupled to the shaft 13 of the impeller, whereby the motor unit 3 is connected to the pump unit 4.

Figure 7:
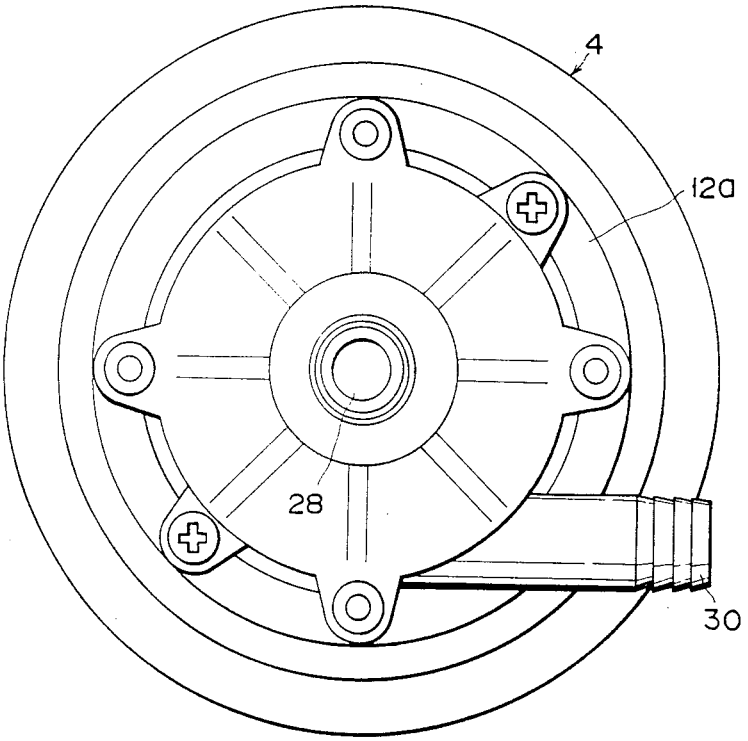
FIG. 7 is a side view of the pump unit incorporated in the bathtub shown in FIG. 6.

FIG. 7 is a side view of the pump unit 4 shown in FIG. 6. As is shown in this figure, an intake hose 16 is connected to the input port 28, and a discharge hose 17 is connected to the output port 30 of the pump unit 4.

The bathtub according to the present invention is not limited to the four embodiments described thus far. Various changes and modifications are possible within the scope of the invention. For instance, the impeller incorporated in the pump unit 4 can be replaced with any other type of a rotary pump that has a shaft (13). Further, the thin portion 2 cf the bathtub 1 can have any shape other than those adopted in the above embodiments, provided that it allows the permanent magnets 8 of the motor unit 3 to oppose the permanent magnets 15 of the pump unit 4.

Bath systems according to the fifth to eighth embodiments of the invention will now be described with reference to FIGS. 8 to 14.

Figure 8:
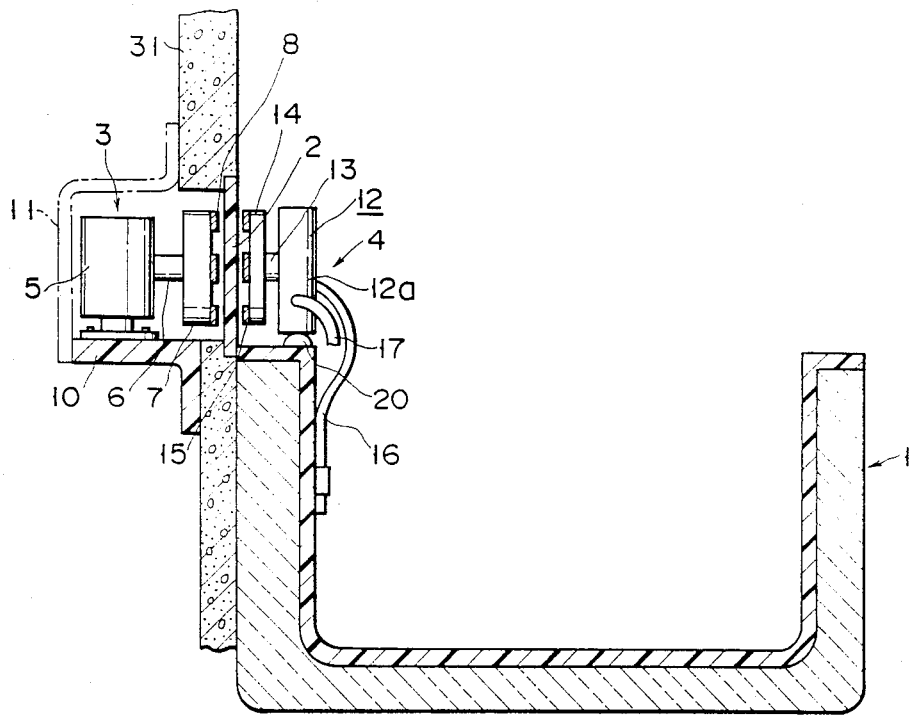
FIG. 8 is a sectional view illustrating the main components of a bath system, which is a fifth embodiment of the present invention.

FIG. 8 illustrates the bath system according to a fifth embodiment of the invention. The system has a bathtub 1 and four side walls 31 of a bathroom. One of the walls 31 has a thin portion 2. The thin portion 2 is made of non-magnetic material, or more precisely glass or hard plastics not permeating magnetism. A motor unit 3 is attached to the outer surface of the thin portion 2. A pump unit 4 is secured to the inner surface of the thin portion 2 and axially aligned with the pump unit 3.

Figure 9:
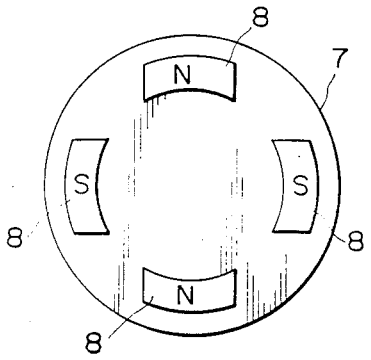
FIG. 9 is a diagram showing the positions of the permanent magnets incorporated in the fifth embodiment.

The motor unit 3 comprises an electric motor 5, a drive drum 7 fastened to the shaft 6 of the motor 5, and a plurality of permanent magnets 8 attached, by means of adhesive or the like, to that surface of the drive drum 7 which faces the outer surface of the thin portion 2. As is shown in FIG. 9, the magnets 8 of N pole and the magnets of S pole are alternately arranged in a circle, set apart from one another at regular intervals. The magnets 8 are spaced a little from the inner surface of the thin portion 2. According to the invention, all magnets 8 can be of either the N pole or the S pole. The motor 5 is secured, by means of fastening means such as bolts, to a support 10 formed integral with the side wall 31 of bathroom. The motor unit 3 is protected by a cover 11. The cover 11 can be dispensed with.

The pump unit 4, which is located inside the walls 31, is attached to the thin portion 2 by means of a suction cup. The unit 4 comprises a pump 12. The pump 12 has a casing 12*a* (i.e., the chamber of the pump). The casing 12*a* contains an impeller (not shown). The shaft 13 of the impeller protrudes from casing 12*a*. A driven drum 14 is attached to the end of this shaft 13, and oppose the inner surface of thin portion 2. A plurality of permanent magnets 15 is attached to that surface of driven drum 14 which faces inner surface of the thin portion 2. The magnets 15 of N pole and the magnets of S pole are alternately arranged in a circle, set apart from one another at regular intervals, as is shown in FIG. 9. These magnets 15 and the magnets 8 attached to drive drum 7 constitute a coupling for magnetically connecting the shaft 13 of the pump 12 to the shaft 6 of motor 5. Thus, when the shaft 6 of the motor 5 rotates, the shaft 13 of the pump 12 is rotated. As a result, the impeller, which is coupled to the shaft 13 and contained in casing 12*a*, is driven, thus pumping the hot water from bathtub 1 into the casing 12*a* through intake hose 16. As the impeller keeps on rotating, the pressure of the water in the casing 12*a* increases. The pressurized water flows from the outlet port of the pump 12 to the nozzle of a massage device (not shown) through discharge hose 17. The hot water jets out of the nozzle into the hot water in the bathtub 1, thus applying successful water-jet massage to the occupant of the bathtub.

As has been described, the motor unit 3 and the pump unit 4 are located in face-to-face relation, with the thin portion 2 of the side wall 31 interposed between them, and the motor unit 3 is positioned outside the bathtub 1. Therefore, no water can leak from the bathtub 1 into the motor unit 3 along the shaft 13 of the impeller incorporated in the pump unit 4. Hence, no troubles are likely to occur in the motor unit 3. In addition, since the motor unit 3 is arranged outside the side wall 31, the bath system is advantageous in two respects. First, bathroom is more spacious than in the case where the motor unit 3 is arranged within bathroom. Secondly, since side wall 31 which has the thin portion 2 is a partition for the bathroom, the occupant of the bath system will not be disturbed by the noise the motor unit 3 makes.

Figure 10:
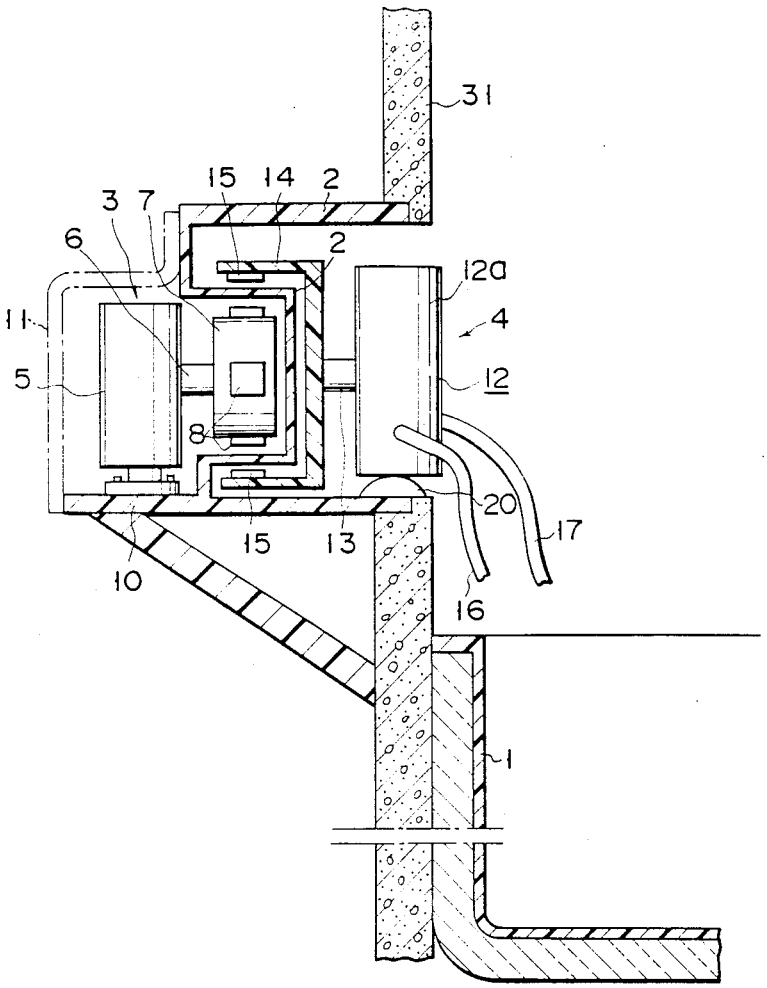
FIG. 10 is a sectional view illustrating the major components of a bath system according to a sixth embodiment of this invention.

FIG. 10 shows the bath system according to the sixth embodiment of the invention. In FIG. 10, the same numerals are used to designate the same components as those shown in FIG. 8. One of its side walls 31 has a thin portion 2 bulging into bathroom and having a cross section like that of a channel bar. A motor unit 3 is provided within the bathroom, and a pump unit 4 is located outside the bathroom. These units 3 and 4 are arranged, opposite to each other, with the thin portion 2 interposed between them. The motor unit 3 and the pump unit 4 are magnetically coupled, as will be detailed below.

Figure 11:
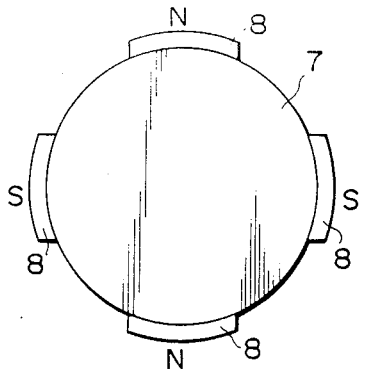
FIG. 11 is a diagram showing the positions of the permanent magnets used in the sixth embodiment.

As is illustrated in FIG. 10, the motor unit 3 comprises an electric motor 5, a drive drum 7 fastened to the shaft 6 of the motor 5, and a plurality of permanent magnets 8 attached to the circumferential surface of the drive drum 7. As is shown in FIG. 11, the magnets 8 of N pole and the magnets of S pole are alternately arranged on the circumferential surface of the drum 7, set apart from one another at regular intervals. The pump unit 4 comprises a pump 12. The pump 12 has a casing 12*a* (i.e., the chamber of the pump). The casing 12*a* contains an impeller (not shown). The shaft 13 of the impeller protrudes from casing 12*a*. A hollow cylindrical, driven drum 14 is attached to the end of this shaft 13, is positioned coaxial with the drive drum 7, and surrounds the circumferential surface of the drum 7. A plurality of permanent magnets 15 is attached to the inner circumferential surface of driven drum 14. The magnets 15 of N pole and the magnets of S pole are arranged in the same way as the magnets 8 are on the circumferential surface of the drive drum 7. As in the first embodiment, the magnets 8 and the magnets 15 constitute a coupling for magnetically connecting the shaft 13 of the pump 12 to the shaft 6 of motor 5. Thus, when the shaft 6 of the motor 5 rotates, the shaft 13 of the pump 12 is rotated.

The sixth embodiment shown FIG. 10 is identical with the fifth embodiment (FIG. 8), in all other structural aspects. It achieves the same advantages as the fifth embodiment (FIG. 9).

Figure 12:
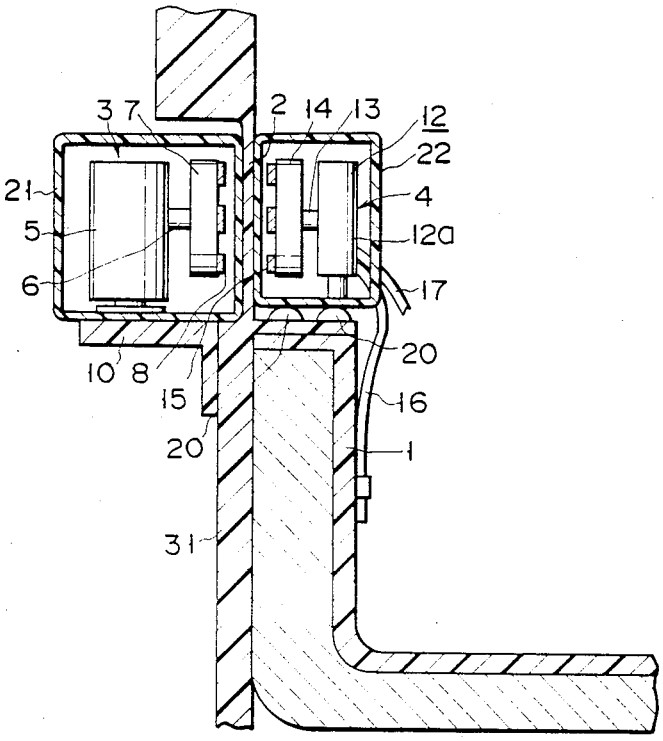
FIG. 12 is a sectional view illustrating the major components of a bath system according to a seventh embodiment of the invention.

FIG. 12 illustrates the bath system according to a seventh embodiment of the invention. In this figure, the same numerals are used to denote the same components as those shown in FIG. 8. One of its side walls has a thin portion 2. A motor unit 3 is provided within the bathroom, and a pump unit 4 is located outside the side wall 31. The units 3 and 4 are arranged, opposite to each other, with the thin portion 2 interposed between them. The units 3 and 4 are magnetically coupled, as will be detailed in the following paragraph.

As is illustrated in FIG. 12, the motor unit 3 comprises an electric motor 5, a drive drum 7 fastened to the shaft 6 of the motor 5, and a plurality of permanent magnets 8. The magnets 8 are attached to the drive drum 7 and arranged exactly in the same manner as in the first embodiment, as is shown in FIG. 9. The pump unit 4 comprises a pump 12. The pump 12 has a casing 12*a* (i.e., the chamber of the pump). The casing 12*a* contains an impeller (not shown). The shaft 13 of the impeller protrudes from casing 12*a*. A driven drum 14 is attached to the end of this shaft 13 and positioned coaxial with the drive drum 7. A plurality of permanent magnets 15 is attached to the that face of the drum 14 which faces the inner surface of the thin portion 2. This magnets 15 are arranged in the same way as the magnets 8. As in the fifth embodiment, the magnets 8 and the magnets 15 constitute a coupling for magnetically connecting the shaft 13 of the pump 12 to the shaft 6 of motor 5. Thus, when the shaft 6 of the motor 5 rotates, the shaft 13 of the pump 12 is rotated.

The seventh embodiment is different from the first embodiment in that two envelopes or housings 21 and 22, either made of a synthetic resin, cover the motor unit 3 and the pump unit 4, respectively. These envelopes 21 and 22 prevent water from leaking into the units 3 and 4. In any other structural aspect, the seventh embodiment shown FIG. 12 is identical with the fifth embodiment (FIG. 8). Also, it accomplishes the same advantages as the fifth embodiment (FIG. 8).

Figure 13:
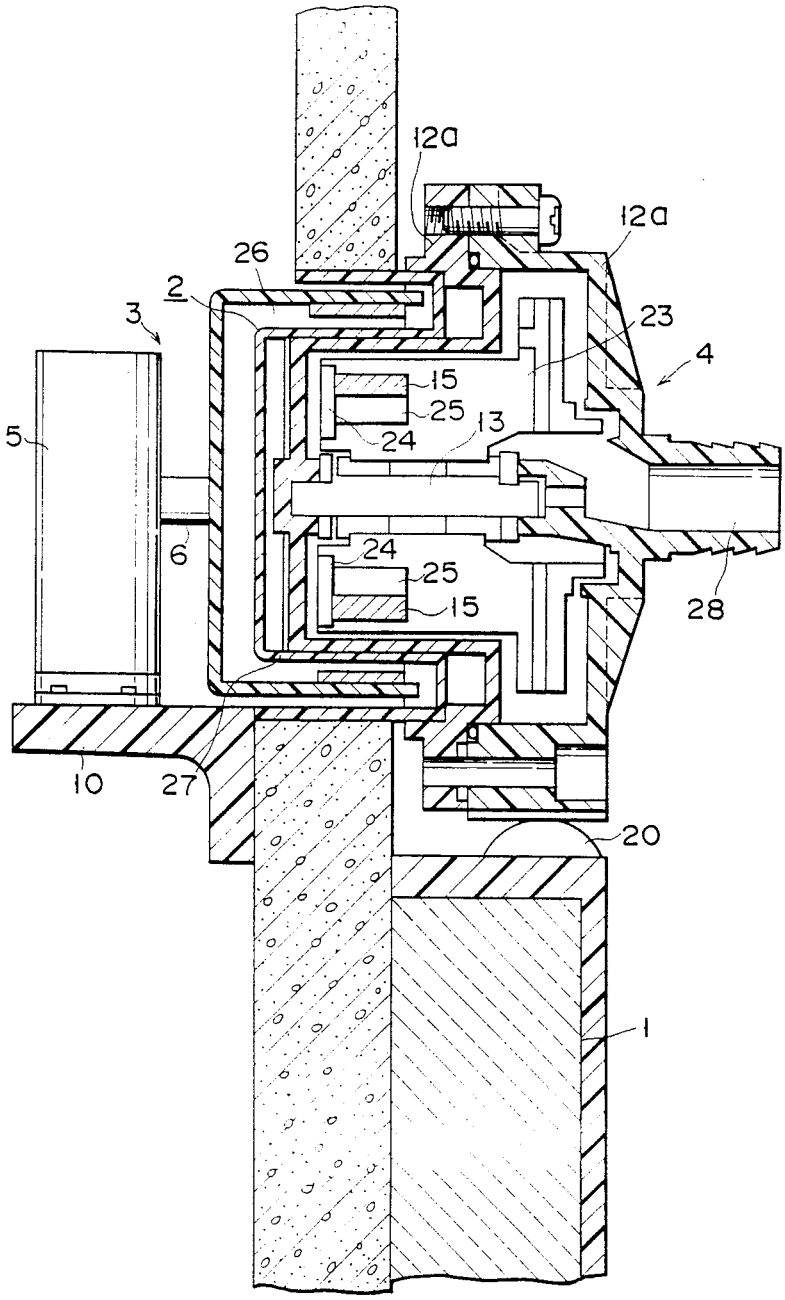
FIG. 13 is a sectional view illustrating the main components of a bathtub according to a fourth embodiment of the present invention.

FIG. 13 shows the bath system according to an eighth embodiment of these invention. This embodiment is a modification of the sixth embodiment shown in FIG. 10. In FIG. 13, the same numerals are used to designate the same components as those shown in FIG. 10. The eighth embodiment differs in two respects. First, the drive drum 7 is a hollow cylinder, and the permanent magnets 8 are attached to the inner circumferential surface of the drum 7. Secondly, the permanent magnets 15 are attached to the vanes 23 of the impeller contained in the casing 12*a*. More specifically, support plates 24 are fixed to the tips of the vanes 23, yokes 25 are secured, at one end, to the support plates 24 and extend parallel to permanent magnets 8, and the permanent magnets 15 are fastened to the outer peripheries of these yokes 25.

The eighth embodiment also differs in that the thin portion 2 is bent in the form of a hat, such that an annular space 26 and a bottomed hollow cylinder 27 are formed. The drive drum 7, which is a hollow cylinder, is loosely inserted in this space 26. The casing 12*a*, which is a bottomed cylinder, is mounted on the hollow cylinder 27. As has been described, the permanent magnets 8 are fastened to the inner circumferential surface of the drum 7, and the permanent magnets 15 are attached to the vanes 23 of the impeller. Hence, the shaft 6 of the motor 5 is magnetically coupled to the shaft 13 of the impeller, whereby the motor unit 3 is connected to the pump unit 4.

Figure 14:
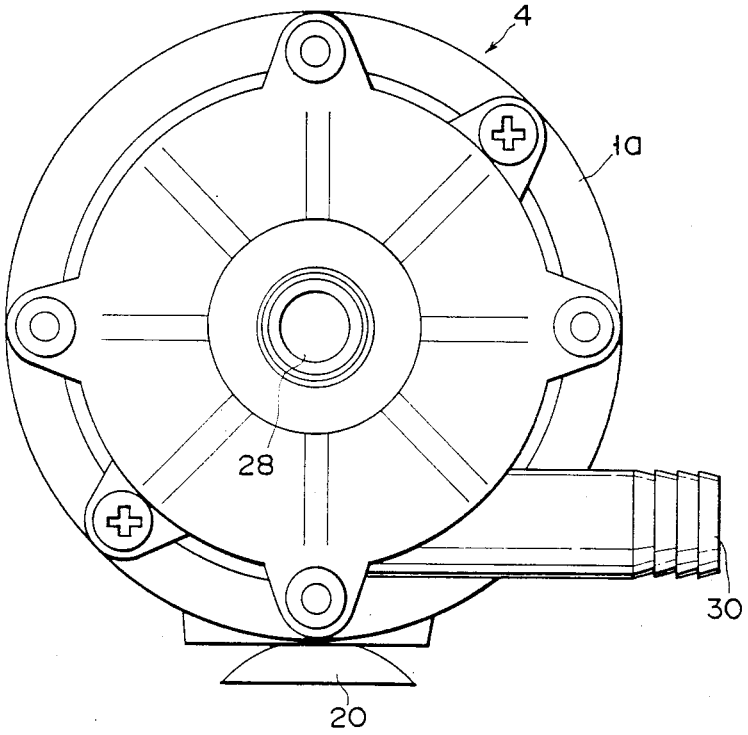
FIG. 14 is a side view of the pump unit incorporated in the bath system shown in FIG. 13.

FIG. 14 is a side view of the pump unit 4 shown in FIG. 13. As is shown in this figure, an intake hose 16 is connected to the input port 28, and a discharge hose 17 is connected to the output port 30 of the pump unit 4.

The bath system according to the present invention is not limited to the fifth to eighth embodiments which have been described above. Various changes and modifications are possible within the scope of the invention. For instance, the impeller incorporated in the pump unit 4 can be replaced with any other type of a rotary pump that has a shaft (13). Further, the thin portion 2 of the bathtub 1 can have any shape other than those adopted in the above embodiments, provided that it allows the permanent magnets 8 of the motor unit 3 oppose the permanent magnets 15 of the pump unit 4.

Moreover, the side wall 31, to which the motor unit 3 and the pump unit 4 are attached in axial alignment with each other, need not have a thin portion when the wall 31 is so thin that magnets 8 and 15 achieve the magnetic coupling between the units 3 and 4.

What is claimed is:

1. A bathing system having a pump for generating a high-pressure jet-stream of water, comprising:

at least one wall having an inner surface, an outer surface, and including a flat thin portion made of magnetically permeable material, an inner surface of said thin portion located co-planar with said inner surface of said wall;

a bath tub arranged so that an upper periphery of the bath tub is located adjacent to said thin portion of said wall;

a pump arranged adjacent to the upper periphery of said bath tub at a position adjacent said inner surface of said thin portion, so as not to be placed under water in said tub, but to take in water from said tub and to pressurize said water;

a motor secured adjacent to an outer surface of said thin portion and opposing said pump; and a magnetic coupling means having a driven drum coupled to said pump and having a surface opposing one side of said thin portion, a drive drum coupled to said motor coaxially with said driven drum and having a surface opposing the other side of said thin portion, a first plurality of magnets fixed to said surface of said drive drum, and a second plurality of magnets fixed to said surface of said driven drum and facing said first plurality of magnets;

said magnetic coupling means being disposed to magnetically couple said pump with said motor through said thin portion without direct contact between said motor and said pump.

2. A bath system according to claim 1, wherein said pump includes a casing rotatably enclosing an impeller on a shaft having first and second end portions, said first end portion defining a rotational axis for said impeller and being coupled to said impeller via the casing, said second end portion mounting said driven drum;

said motor includes a drive shaft having a distal portion projecting outward, said drive drum fixed to the distal portion of the drive shaft; and wherein said second plurality of driven magnets have a polarity opposite to that of said first plurality of driving magnets.

3. A bath system according to claim 2, wherein said drive drum and said driven drum are concentrically arranged; and wherein said first plurality of magnets and said second plurality of magnets are fixed on end surfaces of the driving and driven drums, respectively, in opposed relationship.

4. A bathing system according to claim 3, wherein said motor has a housing which seals the motor therein.

5. The bathing system according to claim 1, further comprising a first envelope enclosing said pump and a second envelope enclosing said motor.

* * * * *